US009174755B2

(12) United States Patent
Mongstad et al.

(10) Patent No.: US 9,174,755 B2
(45) Date of Patent: Nov. 3, 2015

(54) MEANS FOR EMPTYING PACKAGES

(75) Inventors: Eirik Mongstad, Oslo (NO); Kurt Allan Rasmussen, Kolsås (NO); Erling Ekrene, Spikkestad (NO); Thomas Klemetsen, Tranby (NO)

(73) Assignee: National Oilwell Varco Norway AS, Kristiansand S (NO)

( * ) Notice: Subject to any disclaimer, the term of this patent is extended or adjusted under 35 U.S.C. 154(b) by 479 days.

(21) Appl. No.: 12/734,853

(22) PCT Filed: Dec. 10, 2008

(86) PCT No.: PCT/NO2008/000439
§ 371 (c)(1),
(2), (4) Date: Jun. 24, 2010

(87) PCT Pub. No.: WO2009/075584
PCT Pub. Date: Jun. 18, 2009

(65) Prior Publication Data

US 2010/0303591 A1 Dec. 2, 2010

(30) Foreign Application Priority Data

Dec. 10, 2007 (NO) ..... 20076376

(51) Int. Cl.
*B65B 69/00* (2006.01)

(52) U.S. Cl.
CPC ..... *B65B 69/0008* (2013.01); *B65B 69/0033* (2013.01)

(58) Field of Classification Search
CPC ..... B65B 69/0008
USPC ..... 414/412; 209/288
See application file for complete search history.

(56) References Cited

U.S. PATENT DOCUMENTS

| | | | | |
|---|---|---|---|---|
| 3,386,602 | A * | 6/1968 | Kanarek | 414/412 |
| 3,825,018 | A * | 7/1974 | Ferraro | 460/103 |
| 3,834,630 | A | 9/1974 | Nelson | |
| 4,181,461 | A * | 1/1980 | Bernicot | 414/412 |
| 4,182,592 | A | 1/1980 | Henryson | |
| 4,278,384 | A * | 7/1981 | Marchesini | 414/412 |

(Continued)

FOREIGN PATENT DOCUMENTS

| | | |
|---|---|---|
| EP | 0 172 976 | 3/1986 |
| EP | 1 123 868 A1 | 8/2001 |

(Continued)

*Primary Examiner* — Jonathan Snelting
(74) *Attorney, Agent, or Firm* — Cozen O'Connor

(57) ABSTRACT

The invention relates to a sack cutting means (10) for offshore emptying of content from a package, comprising a means (11) for cutting up the package, means (21) for separating the package from its content and means (20) for removing the emptied package from the cutting means, said means (21) for separating the content at least from the package comprising means (13) for ripping the package open, one or more transporting means and a rotating drum (21) provided with openings through which the content separated from the package is allowed to leave the drum (18). Further, the sack cutting screw (11) is separated from the drum (18) and that below both the sack cutting screw (11) and the drum (17), a means (20) for collecting and transporting away the content of the sacks is arranged, said means being configured in such way that the content of the package is removed at one end, while the waste package is removed at the other end of said sack cutting means (10).

12 Claims, 2 Drawing Sheets

(56) References Cited

U.S. PATENT DOCUMENTS

| | | | | |
|---|---|---|---|---|
| 4,543,029 | A | 9/1985 | Grün et al. | |
| 4,751,970 | A * | 6/1988 | Hecker et al. | 173/104 |
| 4,930,968 | A | 6/1990 | Borglund | |
| RE34,458 | E * | 11/1993 | Fahrenholz | 241/74 |
| 5,607,587 | A * | 3/1997 | Langner | 210/380.3 |
| 6,868,973 | B1 * | 3/2005 | Kamo et al. | 210/403 |
| 7,044,307 | B2 * | 5/2006 | Kamo et al. | 210/391 |
| 2007/0084760 | A1 * | 4/2007 | Tse | 209/288 |

FOREIGN PATENT DOCUMENTS

| | | |
|---|---|---|
| GB | 2 206 297 A | 1/1989 |
| SE | 404 170 | 9/1978 |
| SE | 421 063 | 11/1981 |

* cited by examiner

MEANS FOR EMPTYING PACKAGES

PRIORITY CLAIM

This is the U.S. national stage of application No. PCT/NO2008/000439, filed on 10 Dec. 2008. Priority is claimed from Norway Patent Application No. 20076376, filed 10 Dec. 2007, the entire content of which is expressly incorporated herein by reference.

THE TECHNICAL FIELD

The present invention relates to means for cutting sacks in order to empty a more or less powder shaped content into a container means, such as for example a bag or the like. More specifically, the invention relates to a means for emptying the content out of a package at an offshore location, comprising a means for cutting up the package, means for separating the content in the sacks from the sacks and means for removing the emptied packages. The means for separating the content at least from the package comprises a means for cutting up the package, one or more transporting screws and a rotating drum provided with openings, through which the separated content of the packages is allowed to escape out of the drum.

BACKGROUND FOR THE INVENTION

During drilling of offshore wells a drill liquid is required. Such drill liquid may be water based or oil based. The drill liquid consists of a mixture of a number of different chemicals and compounds, and several of these ingredients represent a risk for the human being. The chemicals are commonly supplied in sacks of 25-30 kg and the content of the sacks is fed into a mixer and mixed into a circulating drill fluid. The drill fluid has to be tailor made to the specific requirements at any time, the need for different mixtures often being changed. On this basis it is thus required that the mixing of the drill liquid is executed on the platform as an integral part of the drilling operation.

The problem to be solved is thus how to cut up the sacks and empty these in order to mix the content of the sacks into the circulating drill liquid in a most efficient manner. Such mixing should, amongst other due to the health hazards, but also from an economical point of view, be automatic and without representing a health risk for the operator.

A large number of different machines, performing such operations, are already available on the market.

U.S. Pat. No. 4,930,968 describes a sack cutting machine comprising a unit for cutting up the sack so that the powder inside may be released, a first transporting screw for transport of the powder and the sack; a drum for separating the powder from the sack, the first transport screw being concentrically arranged in the drum; a feeding screw arranged below the drum and in open communication with the drum for transport of the powder to a separate location and a means for collecting ripped, empty sacks, arranged at the opposite side of the drum and said first feeding screw, seen with respect to the feeding opening for filled sacks. According to this solution an intact sack with its powder content is fed into the machine at the end of the sack cutting means, whereupon the sack by means of the first transporting screw is moved in a direction towards a stopper whereby the sack is cut and the content released, whereupon the direction of rotation is reversed.

EP 1 123 868 describes a sack cutting machine in the form of a feeding screw, arranged in a tray, provided with fixed knives for cutting the sack, and a drum arranged at one end of the feeding screw, the content being separated from the sack in said drum. At the opposite end an opening directing towards a tray for collection of empty sacks is arranged.

SUMMARY OF THE INVENTION

An object of the invention is to provide a solution suitable for being placed on an offshore platform, such solution also must be reliable and eliminating, or at least substantially reducing, the health risks for the operator.

A second object is to provide a machine securing correct quality of the drill liquid in an efficient and cost optimal way.

A still further object is to provide a machine which quickly may adjust or change the content or mixture of the drill liquid.

The objects are achieved by means of a solution as further defined by the characterized part of the independent claim.

According to the invention, the drum is suspended and floats freely without being supported by shafts and bearings, the drum being suspended by at least one belt extending around the drum, said belt also running over at least one in respect to the drum, separated, rotating driving shaft.

According to one embodiment, said at least one belt is a chain belt running over a correspondingly configured wheel on said at least one driving shaft.

The chain belt may for example be a sphere or ball string running over a correspondingly configured wheel on said at least one driving shaft.

According to a further embodiment the drum may be provided with corresponding tracks extending around the periphery of the drum and co-functioning with said belt in order to cause said rotation of the drum. In connection with the drum, a guiding means may be provided, securing that the drum is kept in proper position during rotation.

Such guiding means may comprise rotating wheels which runs in contact against the outer surface of the drum, at the upper part and possibly also at the lower part of the drum. At last four rotatably arranged wheels may for example be used at the upper end, and possibly also with wheels arranged at the lower end of the drum. In stead of, or in addition, guiding means may be in the form of at least one rail shaped guide having a curved support surface corresponding to the outer shape of the drum. One or more guides may also lie in contact with the lower external surface of the drum.

In order to prevent axial displacement of the drum, the drum may lie on contact with one or more stopping surfaces or means.

With a solution according to the present invention a solution is provided being so compact that the footprint is reduced as much as possible, so that the unit is well suited for being installed on an offshore platform.

SHORT DESCRIPTION OF THE DRAWINGS

In the following an embodiment of the invention shall be described in closer detail, referring to the drawings, where:

DETAILED DESCRIPTION OF THE INVENTION

Figure 1:
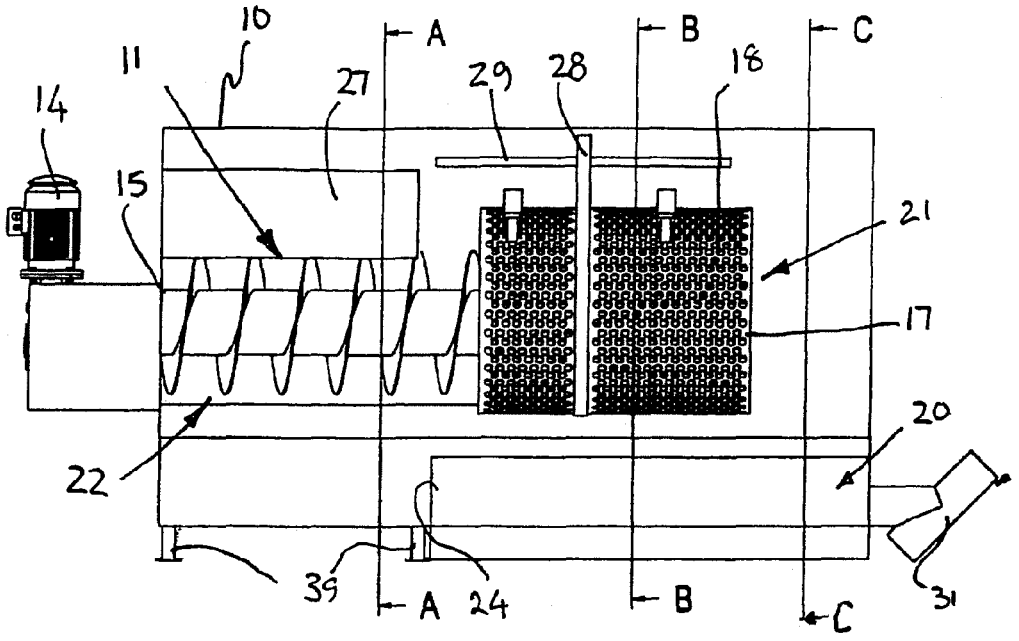
FIG. 1 shows schematically a side view of an embodiment of the invention.

FIG. 1 shows schematically a side view of a preferred embodiment of a sack cutting means 10 according to the invention. The sack cutting means 10 comprises four main elements. These are the cutting means 11, a separation means 21, a transporting means 38 and a compressing means 20.

The cutting means 11 consists of a housing or casing 25 with a rotatable cutting screw 22. The screw is in the form of a central shaft 12 and a helical blade body 13 twisting along the central shaft 12. The blade body 13 is rigidly fixed to the central shaft 12. The screw means 11 is powered by a driving unit 14, such as an electro motor and preferably a gear. At least one end of the screwing means 11 is supported in the housing 15. The housing 15 may preferably surround the screw 13, so that a tray 16 is formed at least at the lower side of the housing. The tray 16 is along its bottom part provided with openings 26 allowing the content of the sacks to escape, so that said content is allowed to fall out of the tray 16. The perforated grating in the tray 16 may preferably be suspended on rubber rails or similar dampening means, allowing a degree of vibration of the tray if required, without transferring possible vibrations to the remaining parts of the machine. Such vibration secures that the content from the sacks is transported out of the tray. A means (not shown) for transferring the content from the sacks for example to a mixing container is arranged below the perforated tray. Such means for transportation may be of any suitable type, well known to the person skilled in the art.

At the end of the housing 15 where the screw 13 is connected to the powering unit 14, the upper part of the housing is provided with an inlet opening 27. The inlet opening 27 may preferably be provided with a preferably dustproof lid, the lid being connected to a switch so that the screw is not allowed to rotate when the lid is not in a closed position. In such way dust and powder is prevented from escaping uncontrolled from the unit and the possibility of causing injury to the operator is eliminated.

At the opposite end of the housing 15 the separating means 21 is arranged. The separating means 21 comprises a house or a casing comprising a cylindrical, rotatably arranged grating or drum 17, separating the remaining part of the powder and the packaging. The separating means is orientated in such way with respect to the cutting screw 22 that the cutting screw 22 is partly projecting into the rotatably arranged grating 17. The grating 17 is provided with openings so that the powder or the fine graded material is fed into the grating by the cutting screw 22, is allowed to fall out through said openings 18, while the ripped sack (not shown) is transported axially out through the rotating drum in any suitable way. The rotatable drum 17 is made of grating or of a perforated plate and is suspended by one or more belts or chains 28 which is suspended on a rotatable shaft 29, connected to a power unit (not shown), such as an electro motor or the like, and preferably a gear. In order to prevent sideways displacement of the drum 17, the drum 17 is kept in place by means of a plurality of guiding wheels 30. Four guiding wheels 30 may for example be used, arranged in pairs in spaced relation from each other at the upper side of the drum 17. Guiding wheels may optionally also be arranged at the lower side of the drum 17. The drum 17 may optionally also be supported against axial movement or displacement by a contact surface or the like knot shown) at each end of the drum 17. Internally in the drum 17 blades 23 are arranged forcing the package around and at the same time 25 moving the package in axial direction out of the drum 17.

Below that part of the sack cutter 10 a compressing means 20 is arranged. Said compressing means 20 comprises a housing 24 containing a rotatable screw 34 rotating in a duct ending at an outlet. This end may be connected to a collecting means, such as a bag for receipt of emptied packages as such emptied sacks are forced out of a transfer pipe 24 and into the collecting means by means of the rotating screw 34. The rotating screw 34 is powered by a driving unit (not shown), such as an electro motor. The outlet 24 is arranged below the sack cutting means and the screw 34 is configured in such way that the emptied sack moves from right towards left in the Figure. An emptied sack exits the drum 21 at the free end and is then fed or falling down through an opening 40 down onto the screw 34, moving the emptied sack back under the drum and out through the opening 24 at the opposite end of the screw 14.

The content in the sacks, which often is in the form of powder, is transported out of the unit 10 through the exit pipe 31, arranged at the end of the unit 10 and communicating with the screw 38.

As shown in FIG. 1 the sack cutting means 10 is supported by a plurality of legs 39.

Figure 2:
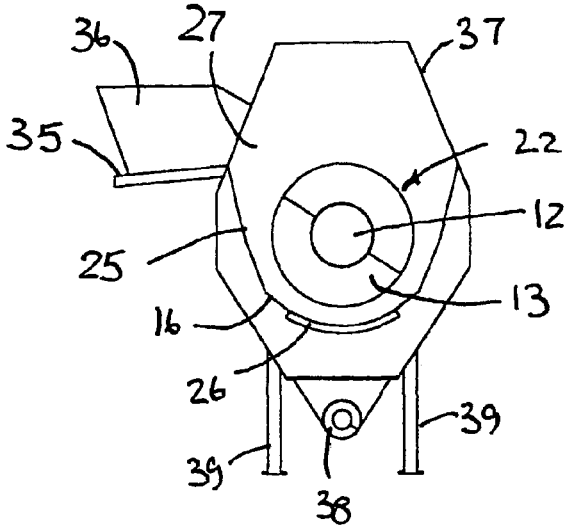
FIG. 2 shows a vertical section through the sack cutting means, seen along the line A-A in FIG. 1.

FIG. 2 shows a vertical section through the screw cutting means 11, seen along the line A-A in FIG. 1. As shown in FIG. 1, a feeding table 35 provided with a cover comprising a dust proof lid 36 is arranged in conjunction with the opening 27. Further, the entire sack cutting means 10 may be completely enclosed in its own housing 37, so that the entire unit is enclosed, thus avoiding emission of dust to the environment. Further, along the bottom of the entire sack cutting unit 30 along its entire length a transport means 38 is arranged for transport of the content of the sacks out of the sack cutting means 10. Said transport means 38 may for example be in the form of a screw or the like, preferably rotating in such direction that the content of the sacks is transported out of the machine. The transport means 38 is arranged at the bottom of a tray shaped channel, the channel being in open communication with a tray 16 above through openings communication with the sack cutting screw 22 and the perforated drum 21. It should be appreciated, however, that in certain cases it may be desirable to provide the sack cutting means with a reservoir comprising a feed in stead of a transport screw.

Figure 3:
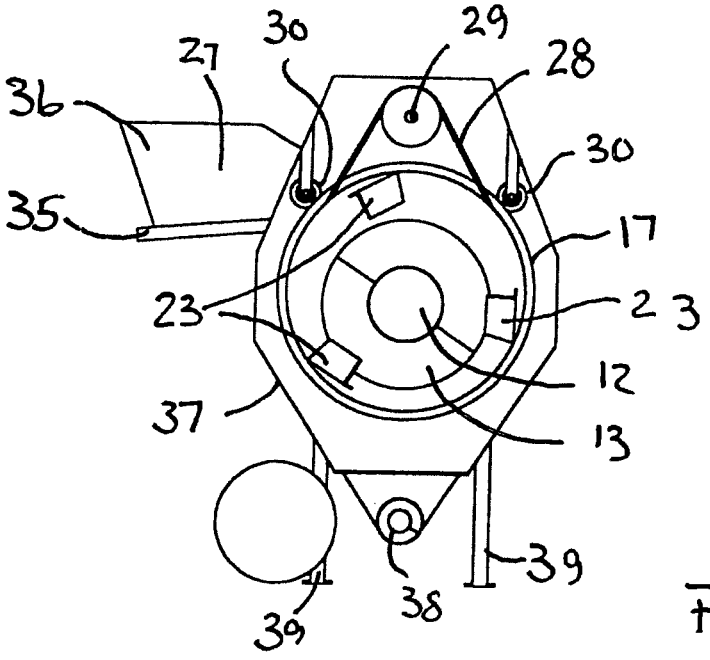
FIG. 3 shows a vertical section through the sack cutting means, seen along the line B-B in FIG. 1.
Figure 4:
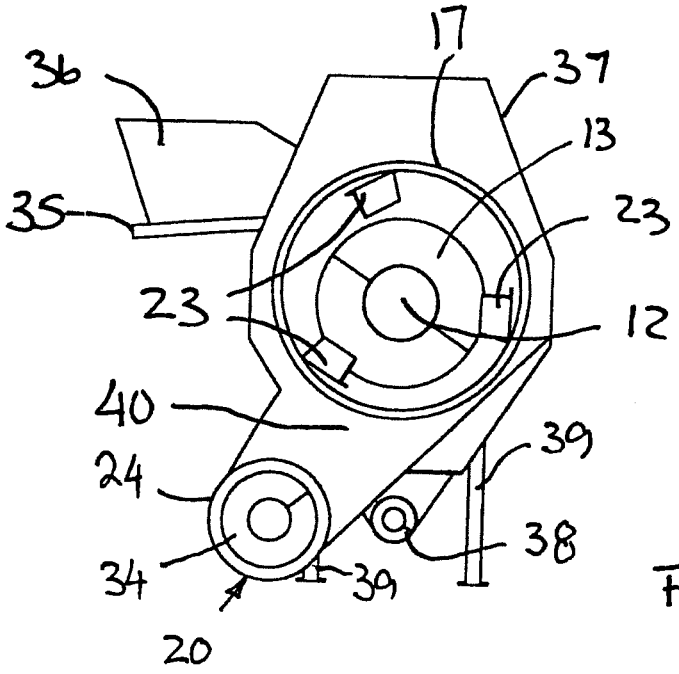
FIG. 4 shows a vertical section through the sack cutting means, seen along the line C-C in FIG. 1.

FIG. 3 shows a vertical section through the part of the sack cutting means 10 where the drum 17 is arranged, while FIG. 4 shows a vertical section seen along the line C-C in FIG. 1. As shown in FIG. 4, an open channel 40 leads the emptied sack down into the compressing unit 20. As indicated in FIG. 4 the compression unit is sideways displaced with respect to the drum 17 and the axis of the cutting blades 13.

The functioning of the sack cutting means according to the invention shall in the following be described in further details.

The sack with its content, for example in the form of a powder or a fine, uniformly graded material, is fed into the sack cutting means 10 through the opening 27. The cutting screw 22 starts and rotates in a direction so that the sack is screwed towards the rotating grating 17. On its way towards the grating 17, the sack is cut open by means of the cutting screw 11, which also transports the opened sack in direction towards the rotating grating 17, while the main part of the content of the sack falls down through the openings 26. According to the invention, the sack is cut into pieces by the helically shaped blades 13 on the screw 11, the blade edges cutting through the sack material. The blades may be provided with knives, securing proper cutting of the sacks. The sack is fed into one end of the rotating grating 17, where the sack is turned around by means of internally arranged blades 23 inside the grating 17. The blades 23 move also the emptied sacks further through the grating 17 and out of the grating 17 at the opposite end. The emptied sack falls down into the compression unit 20 which comprises a compression screw 34. The screw catches the emptied sack and compresses the emptied sack into a collecting means. Such collecting means may for example be a bag or the like.

Even if the cutting screw 11 with its cylindrical core 12 is shown, it should be appreciated that the core 12 of the cutting screw 11 may be conical, having a decreasing diameter in direction towards the drum 17, whereby the sack is compressed more and more and/or cut open more and more in direction towards the drum 17. Further, it should be noted that knives securing proper cutting of the sacks may be used, securing improved opening of the sack, so that the remaining content in the sack more easily may escape out of the sack prior to the sack being fed towards the drum 17. In order to improve the cutting and emptying effect the light openings at the opening between the cutting screw 11 and the drum 17 may also be made as small as possible.

According to the present invention the gradient between the blades of the sack cutting screw may be increased, for example so that the gradient may be reduced, i.e. the distance between the blades being smallest where the sack firstly hits the screw and larger towards the drum 17. This will contribute to stretching of the sack and hence to improved emptying.

Further, it should be appreciated that the grating, used in the bottom of the respective trays, preferably may be replaceable.

In order to secure that dust does no escape uncontrolled, a fan may be arranged inside the unit, thereby establishing a vacuum inside the housing.

The invention claimed is:

1. A package cutting apparatus for offshore emptying of content from the package, comprising:

a cutter configured to cut up the package;

a separator configured to separate the package from its content; and a remover configured to remove an emptied package from the cutter, wherein said separator comprises:

a rotating drum rotating about a drum axis and provided with openings through which the content separated from the package is allowed to leave the drum, and an opening for removing the emptied package, wherein the drum floats freely and is suspended by at least one belt extending around the drum, said at least one belt also running around at least one rotating driving shaft, and wherein the cutter comprises a cutting screw having a central shaft, a screw axis and a helical blade body extending about said screw axis, wherein the screw axis of the cutting screw and the drum axis of the rotating drum are parallel with one another.

2. The package cutting apparatus according to claim 1, wherein said at least one belt is a chain belt running over a correspondingly configured wheel on said at least one driving shaft.

3. The package cutting apparatus according to claim 1, wherein said at least one belt comprises a ball stringed belt running over a correspondingly configured wheel on said at least one driving shaft.

4. The package cutting apparatus according to claim 1, wherein the drum is correspondingly configured with grooves extending around the periphery of the drum and co-functioning with said belt to rotate the drum.

5. The package cutting apparatus according to claim 1, wherein guiding wheels are arranged in conjunction with the drum, securing control of the drum, keeping the drum in position during rotation.

6. The package cutting apparatus according to claim 5, wherein the guiding wheels comprise rotating wheels lying in contact with an exterior of the drum.

7. The package cutting apparatus according to claim 6, wherein at least four rotating wheels are used.

8. The package cutting apparatus according to claim 1, wherein the cutter is configured to transport the cut up package with its separated content to the drum.

9. The package cutting apparatus according to claim 1, wherein the remover comprises a compressor having a housing containing a rotatable screw rotating in a duct ending at an outlet coupled to a collector, and wherein the collector is configured to collect the cut up, emptied, and compressed package.

10. The package cutting apparatus according to claim 1, wherein the cutter is surrounded by a housing that has a lower portion that forms a tray around the cutter, and wherein the lower portion of the housing includes at least one opening configured to allow at least part of the content of the package to escape.

11. The package cutting apparatus according to claim 1, wherein the screw axis and the drum axis are horizontal.

12. The package cutting apparatus according to claim 1, wherein the cutting screw of the cutter extends into the rotating drum.

* * * * *